US005410800A

United States Patent [19]

Gray

[11] Patent Number: 5,410,800

[45] Date of Patent: May 2, 1995

[54] TUBE EXPANDER WITH ROD SUPPORT APPARATUS

[75] Inventor: Kenneth P. Gray, E. Syracuse, N.Y.

[73] Assignee: Carrier Corporation, Syracuse, N.Y.

[21] Appl. No.: 209,768

[22] Filed: Mar. 14, 1994

[51] Int. Cl.[6] ..... B23P 15/00

[52] U.S. Cl. ..... 29/727; 29/890.044; 29/890.043

[58] Field of Search ..... 29/727, 890.044, 890.043, 29/523; 72/370

[56] References Cited

U.S. PATENT DOCUMENTS

| | | | |
|---|---|---|---|
| 4,771,536 | 9/1988 | Vanderlaan et al. | 29/727 |
| 4,780,955 | 11/1988 | Stroup | 29/727 |
| 4,847,989 | 7/1989 | Franks | 29/727 |
| 5,003,691 | 4/1991 | Milliman et al. | 29/727 |
| 5,040,405 | 8/1991 | Honma et al. | 29/890.044 |
| 5,097,590 | 3/1992 | Tokura | 29/727 |
| 5,099,677 | 3/1992 | Tokura | 29/727 |
| 5,127,155 | 7/1992 | Kendic | 29/890.044 |
| 5,129,246 | 7/1992 | Strickland et al. | 29/727 |

*Primary Examiner*—Irene Cuda

[57] ABSTRACT

An apparatus for expanding the tubes in a heat exchanger of the plate fin and tube type. The expander is of the type that expands the tubes by driving an expansion "bullet," attached to and driven by an expander or bullet rod, through the tube. The expander rod in turn is driven by a ram. The expander has a rod support apparatus that prevents the expander rod from buckling under compressive stress. The axes of movement of the ram and the expander rod are offset with the ram imparting its force to the rod through a connector link. A rod support member has a passage to support the expander rod, a passage to allow the ram to pass through the support member and a slotted passage, to allow the connector link to pass through the support member, joining the rod support passage and the ram passage. The rod support apparatus restrains the expander rod from buckling while requiring no increase in the overall length of the tube expander.

1 Claim, 7 Drawing Sheets

TUBE EXPANDER WITH ROD SUPPORT APPARATUS

BACKGROUND OF THE INVENTION

This invention relates generally to apparatus for manufacturing heat exchangers. More particularly, the invention relates to an apparatus, known as a tube expander, for radially expanding the tubes in a plate fin and tube type heat exchanger.

Plate fin and tube type heat exchangers are commonly used in a variety of applications, particularly in air conditioning and refrigeration equipment as well as in engine cooling systems. In such a heat exchanger, a first fluid, typically a refrigerant or an engine coolant, flows through tubes and a second fluid, typically air, flows around the exterior of the tubes. Heat is exchanged between the two fluids through the walls of the tubes. The rate of heat transfer, and therefore the heat transfer performance of the heat exchanger, can be increased by increasing the area of the external surface of the tubes that is exposed to the second fluid. This is typically done by attaching thin metal plates, or plate fins, to the exterior of the tubes. To be effective for transferring heat and also for mechanical reasons, the plate fins must be in firm physical contact with the exterior of the tubes.

FIG. 1 provides further background for the invention. The figure depicts plate fin and tube heat exchanger 10 at an intermediate stage of manufacture. Heat exchanger 10 comprises hairpin tubes 11, tubesheets 12, plate fins 13 and return bends 15. A typical manufacturing process for making heat exchanger 10 includes the steps of bending straight lengths of tubing into hairpin tubes 11, then inserting hairpin tubes 11 through holes in tubesheets 12 and stacks of plate fins 13. In order to allow the passage of the tubes through the tubesheets and plate fins, the holes must be made with a diameter that is slightly larger than the outer diameter of the tubes. After the tubes are inserted into the tubesheets and plate fin stack, the tubes are expanded radially so that the external surface of the tubes firmly contact the fins. The ends of hairpin tubes 11 are expanded to a greater degree than the rest of the tubes in order to form bellmouths 14. Return bends 15 are then inserted into bellmouths 14 to complete a closed flow path for a first fluid to flow through the tubes of heat exchanger 10. The specific configuration of a given heat exchanger may vary. For example, the flow path of the fluid through the tubes may not be a simple series path but the fluid may flow through the heat exchanger in two or more parallel paths. This is accomplished by providing headers instead of return bends. The heat exchanger may also be of the single pass type, with straight rather than hairpin tubes being used so that fluid flows through the heat exchanger from one side to the other. As it applies to the present invention, however, the process of lacing tubes through plate fins having slightly oversize holes, then expanding the tubes to firmly contact the plate fins is common to the manufacture of most types of plate fin and tube heat exchangers.

Although there are a number of means for expanding tubes during the manufacture of a plate fin and tube heat exchanger, the most common way is mechanical, in which an expansion "bullet" is driven through the tube. The bullet is slightly greater in external diameter than the internal diameter of the tube and sized to result in the desired increase in the external diameter of the tube.

The bullet is attached to a rod through which the driving force is applied. As the bullet is driven through a tube, the rod is subjected to a compressive force.

FIG. 2 depicts a typical tube expander and provides further background for the present invention. Expander 20 is of the tension type. By this is meant that the tube to be expanded is in tension during the expansion operation. Heat exchanger 10 is positioned relative to expander 20 so that the longitudinal axis of hairpin tube 11 is aligned with the longitudinal axis of expander bullet 23 and expander rod 22. Gripper jaws 32 hold tube 11 in this aligned position during expansion. Bullet 23 is attached to one end of rod 22 with the attachment means, in some applications, allowing for rotation of the bullet about the axis of the rod. The other end of rod 22 is attached to yoke 24. Ram shaft 25 moves yoke 24 laterally in either direction. Shaft 25 in turn is moved by a motive force (not shown) such as a hydraulic cylinder and piston or a motor and a system of gears, cables and blocks or the like. Bearing blocks 31 support shaft 25 and expander rod 22.

In a tube expansion operation, bullet 23, through rod 22, yoke 24 and shaft 25 is first fully retracted (moved to the right in FIG. 2). Tube 11 is then positioned with respect to bullet 23. Gripper laws 32 engage the tube behind bellmouth 14 to hold the tube in place. Then bullet 23 is driven into tube 11, expanding the wall of the tube, increasing the tube's diameter and thus causing a tight mechanical fit with plate fins 13. Bullet 23 is then withdrawn from tube 11 and, if necessary, heat exchanger 10 repositioned so that another tube or tubes may be expanded. If the tubes being expanded are hairpin tubes, then there should be at least two expander rods and bullets driven by yoke 24, as it is desirable to expand both legs of a given hairpin tube at the same time.

Increasingly, the industry is using tubes of smaller diameters in plate fin and tube heat exchangers. In order to pass through these smaller tubes, the bullet rod must be correspondingly smaller in diameter. A smaller rod is, in general, not as strong as a larger rod. It may be necessary to expand tubes in heat exchangers that are as much as three meters or more in length. A long rod with a small diameter is particularly subject to buckling under compressive forces. Buckling of an expander rod may be prevented if the rod is restrained and supported. FIGS. 3A, 3B and 4 depict one prior art apparatus for providing support to prevent buckling. Like reference numerals in FIGS. 3A, 3B and 4 identify like elements. FIG. 3A shows expander 20 with expander rod 22 in the retracted position. Rod 22 is supported by a number of sliding rod support members 41P. FIG. 4 shows another view of one rod support member 41P. Expander rod 22 slideably extends through channel 43P in the upper portion of support member 41P. The lower portion of support member 41P is slideably mounted in guide slot 44P in bed 21 so that member 41P may move laterally relative to bed 21. During an expansion stroke, support member 41P restrains expander rod 22 and prevents it from buckling. As yoke 24 drives rod 22 into a tube, it also causes support members 41P to move and eventually, at the end of the expansion stroke, as shown in FIG. 3B, to collect at the tube mounting end of bed 21. The design of an expander having this type of rod support apparatus must take into account the combined widths W of support members 41P. The overall length of the expander must be at least W longer than a similar expander without the support members. The smaller the diameter of the expander rod used, the more support is required to prevent buckling and thus the more support members are required, resulting in a greater width W. In an expander capable of expanding very small diameter tubes in a very long heat exchanger, the additional length penalty can be quite significant.

What is needed, therefore, is a rod support apparatus for a tube expander that will afford adequate support to the expander rod or rods to prevent buckling but will not require that the expander to be longer because of its presence.

SUMMARY OF THE INVENTION

The present invention is a tube expander having a rod support apparatus to prevent its expander rods from buckling. The apparatus extracts no length penalty because of its presence on the expander.

The support apparatus comprises one or more rod support members mounted to the bed of the expander. Each rod support member has a channel within it that is coaxially aligned with the expander rod that the member is intended to support. The size of the rod channel is such that the rod can easily slide within it while preventing buckling. Each rod support member also has another channel within it that is configured and sized so that the yoke and ram shaft may easily move within it. Connecting the rod channel and the ram shaft channel is a longitudinal slot. The width of the slot is such that it does not degrade the ability of the rod passage to support the rod and prevent buckling. A connector link that can slide through the slot joins the yoke to the expander rod and enables the ram shaft, through the yoke, to drive the expander rod into a tube. The support member supports the expander rod through the entire length of the rod's travel over the bed of the expander without interfering with the stroke length of the expander or adding to the length of the expander.

BRIEF DESCRIPTION OF THE DRAWINGS

The accompanying drawings form a part of the specification. Throughout the drawings, like reference numbers identify like elements.

DESCRIPTION OF THE PREFERRED EMBODIMENTS

Figure 3A:
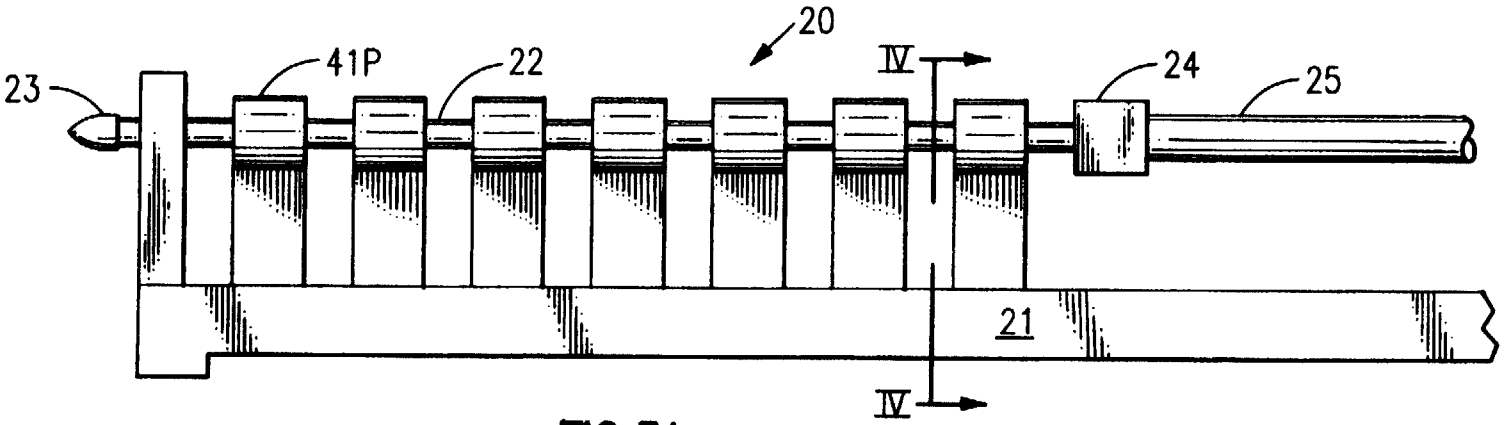
FIG.3A Prior Art
FIGS. 3A and 3B are side elevation views of a tube expander having a prior art type of rod support apparatus.
Figure 3B:
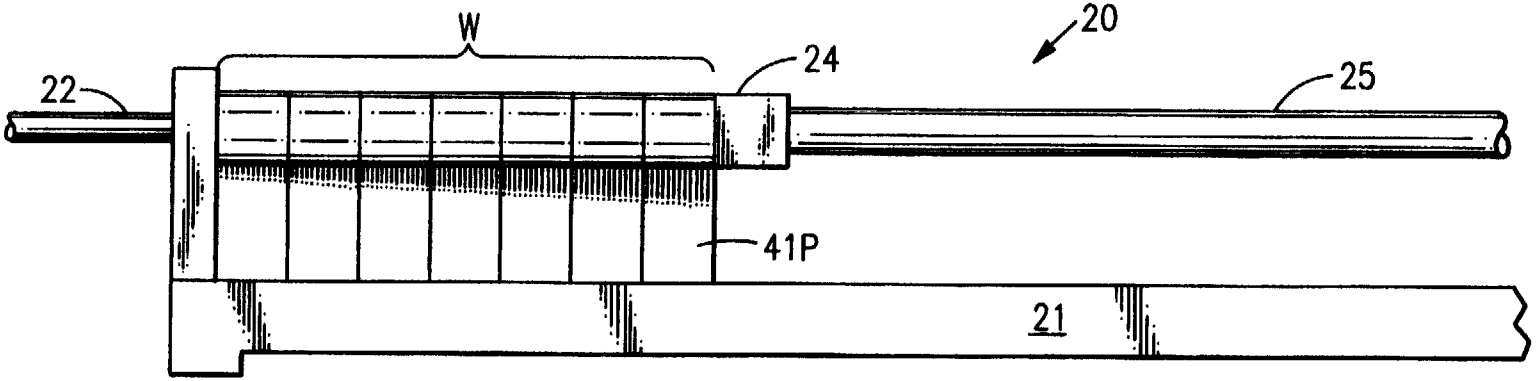
FIG.3B Prior Art
Figure 4:
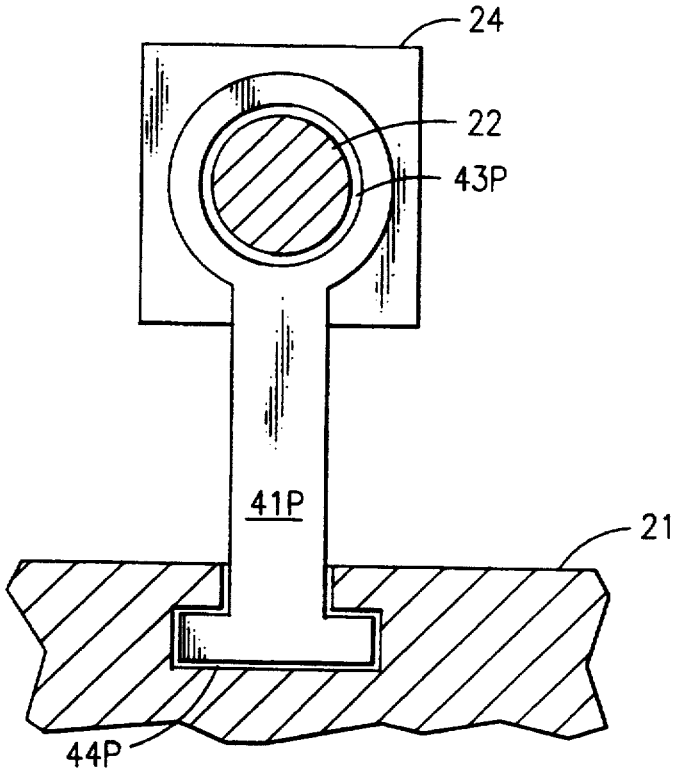
FIG.4 Prior Art
FIG. 4 is a partial sectioned elevation view, through line 4—4 in FIG. 3A, of a prior art type of rod support apparatus.
Figure 5A:
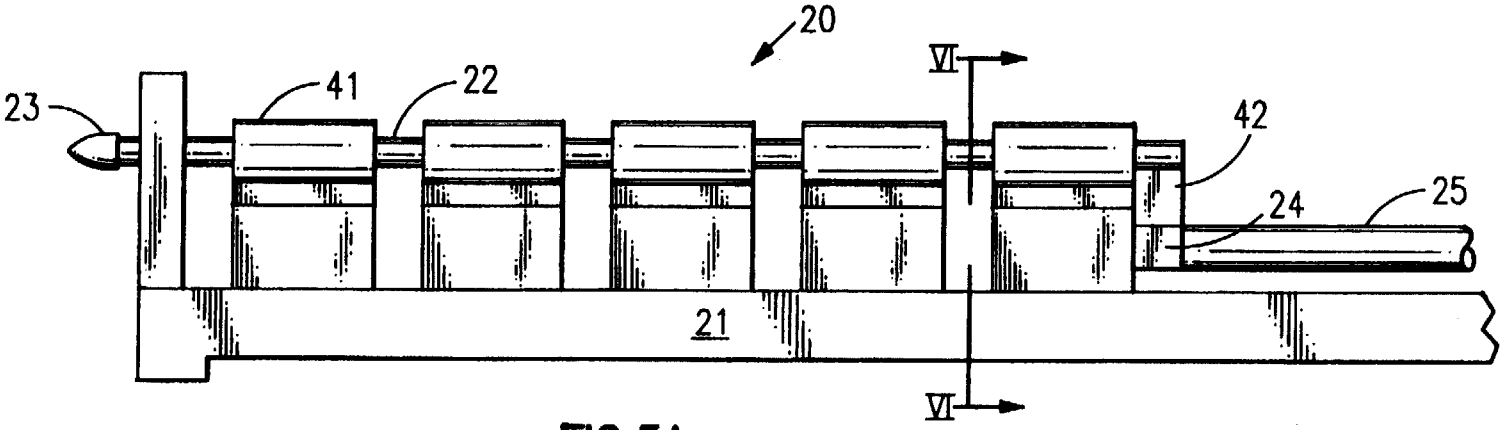
FIGS. 5A and 5B are side elevation views of a tube expander having a rod support apparatus made according to the present invention.
Figure 5B:
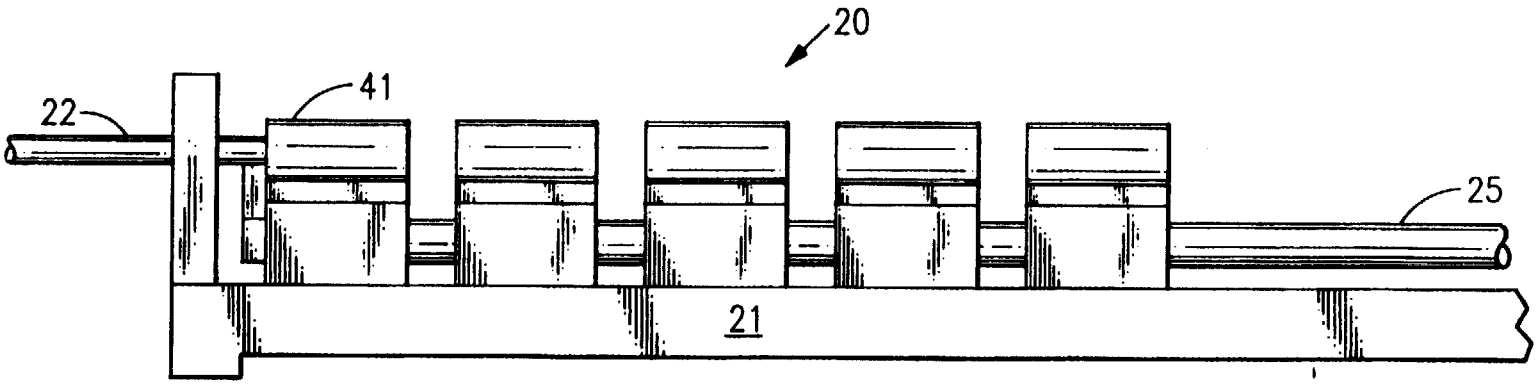

FIGS. 5A and 5B depict a tube expander 20 having bed 21 upon which is mounted the rod support apparatus of the present invention. FIG. 5A depicts expander 20 with expander rod 22 in the retracted position ready to expand a tube. FIG. 5B depicts expander 20 with expander rod 22 in the extended position as after expanding a tube. Rod support member 41 is positioned to support rod 22 and prevent buckling. Unlike the rod support members shown in FIGS. 3A and 3B, rod support member 41 is fixed to bed 21. Also unlike the prior art support members, there may be multiple members as shown in FIGS. 3A and 3B or there may be just a single member (not shown) that provides support to expander rod 22 over all or substantially all of the length of bed 21. Also unlike the prior art, expander rod 22 and ram shaft 25 are not coaxial but rather the axes of these two elements are offset. Rod 22 is joined to yoke 25 by means of connector link 42 so that connector link 42 imparts the motion of ram shaft 25 to expander rod 22.

Figure 6:
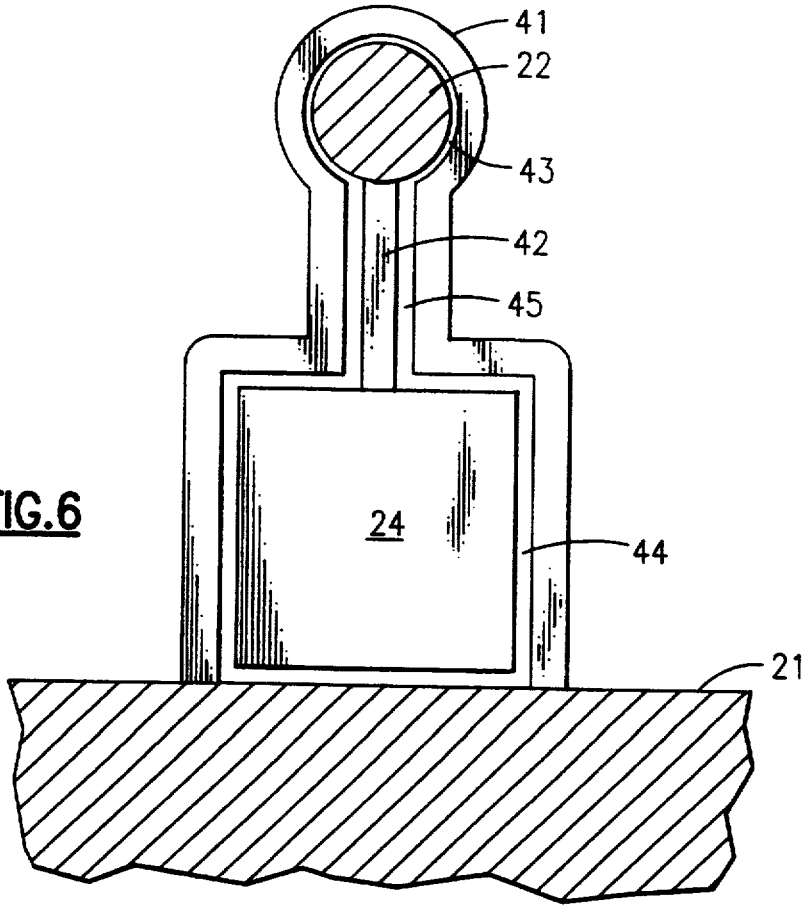
FIG. 6 is a partial sectioned elevation view, through line 6—6 in FIG. 5A of a tube expander having a rod support apparatus made according to the present invention.
Figure 7:
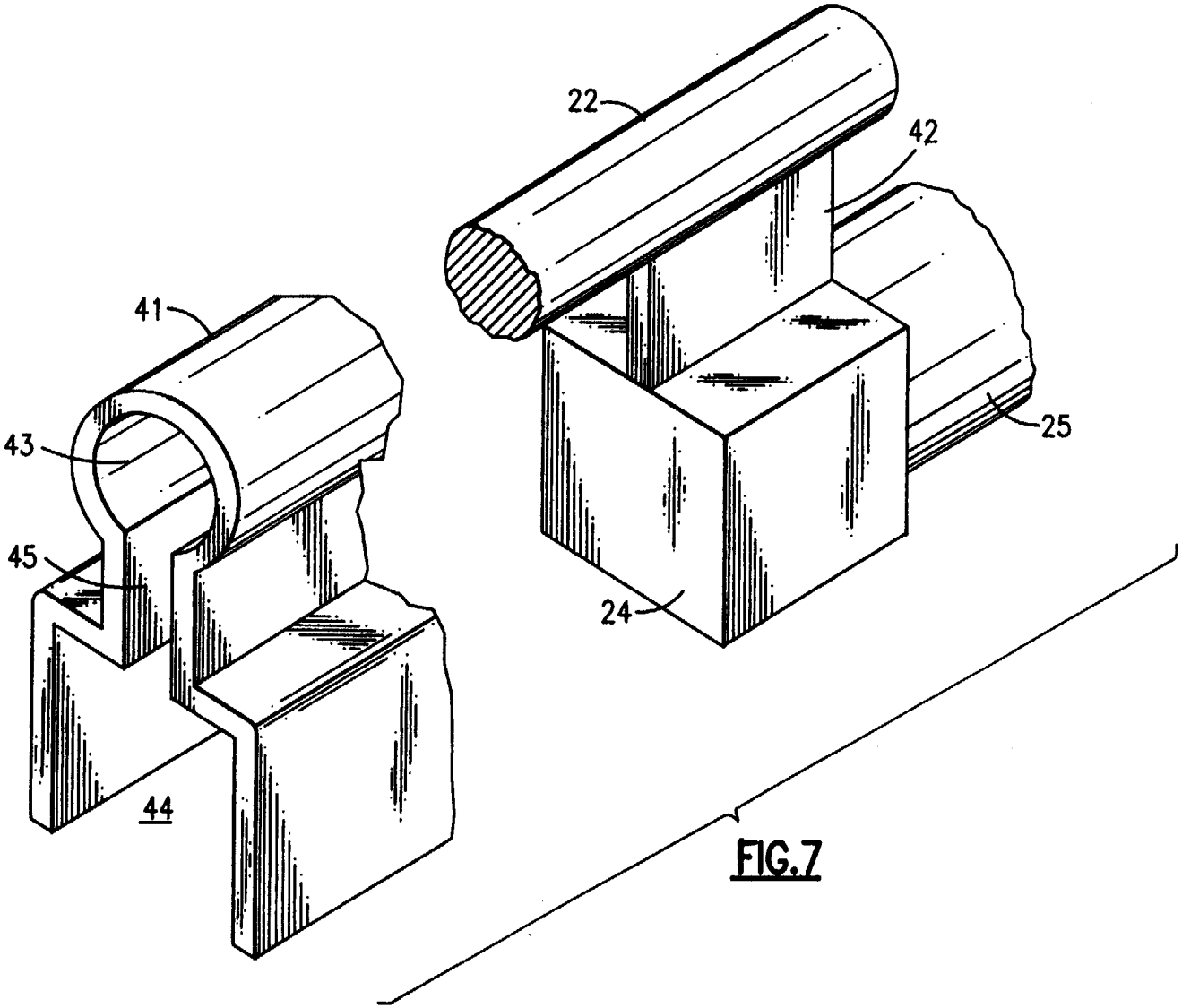
FIG. 7 is an isometric view of a portion of a rod support apparatus made according to the present invention.

FIGS. 6 and 7 provide more information on the construction of the rod support apparatus. In the upper portion of rod support member 41 is rod channel 43. Rod channel 43 is configured and sized so that expander rod 22 can slideably pass through the channel without resistance but also so that any tendency of expander rod 22 to buckle during an expansion stroke of expander 20 will be prevented by the wall of the channel.

In the lower portion of rod support member 41 is ram channel 44. Ram channel 44 is configured and sized so that yoke 24 and ram shaft 25 can slideably pass through the channel without resistance. Ram shaft 25 should be of sufficient size and strength so that it is not subject to buckling under the compressive stresses it undergoes during an expansion stroke of expander 20.

Between and connecting ram channel 43 and ram channel 44 is link channel 45. Link channel 45 is configured and sized so that connector link 42 can slideable pass through the channel without resistance but also so that expander rod 22 cannot buckle into the channel.

Figure 1:
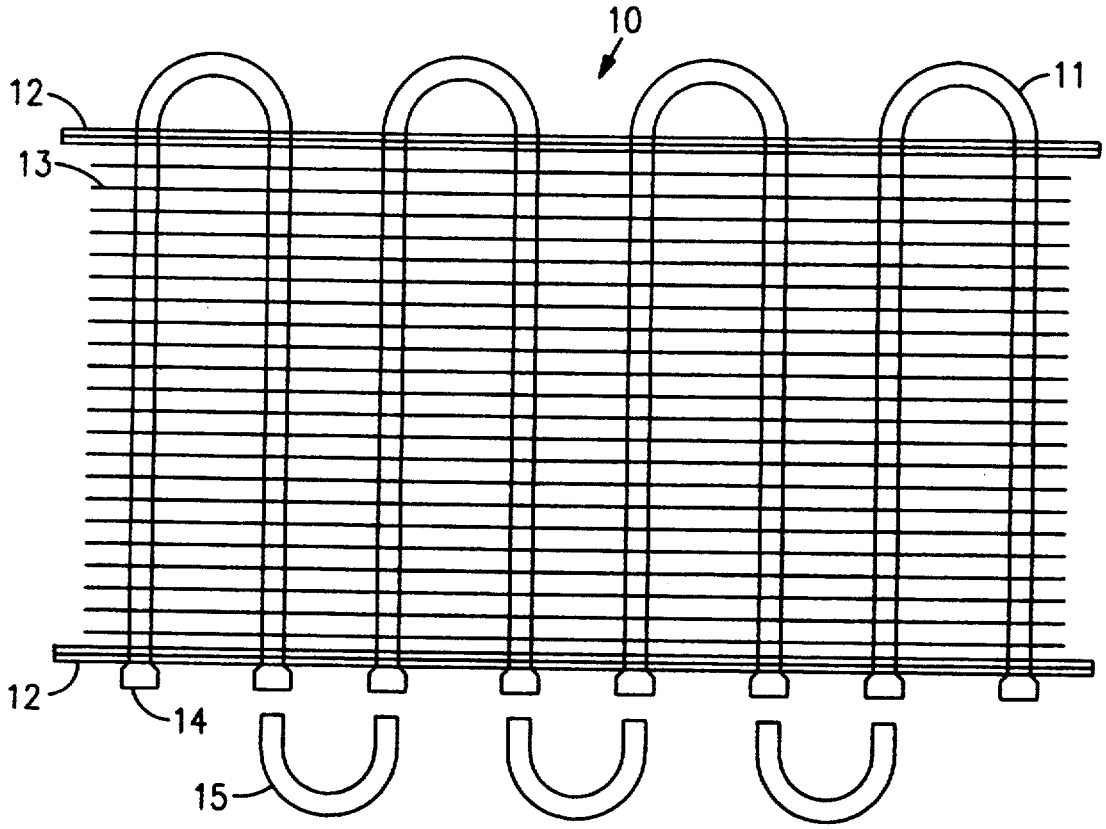
FIG. 1 is a schematic diagram of a typical plate fin and tube heat exchanger, in an intermediate stage of manufacture, of the type upon which the expander of the present invention would be used.
Figure 2:
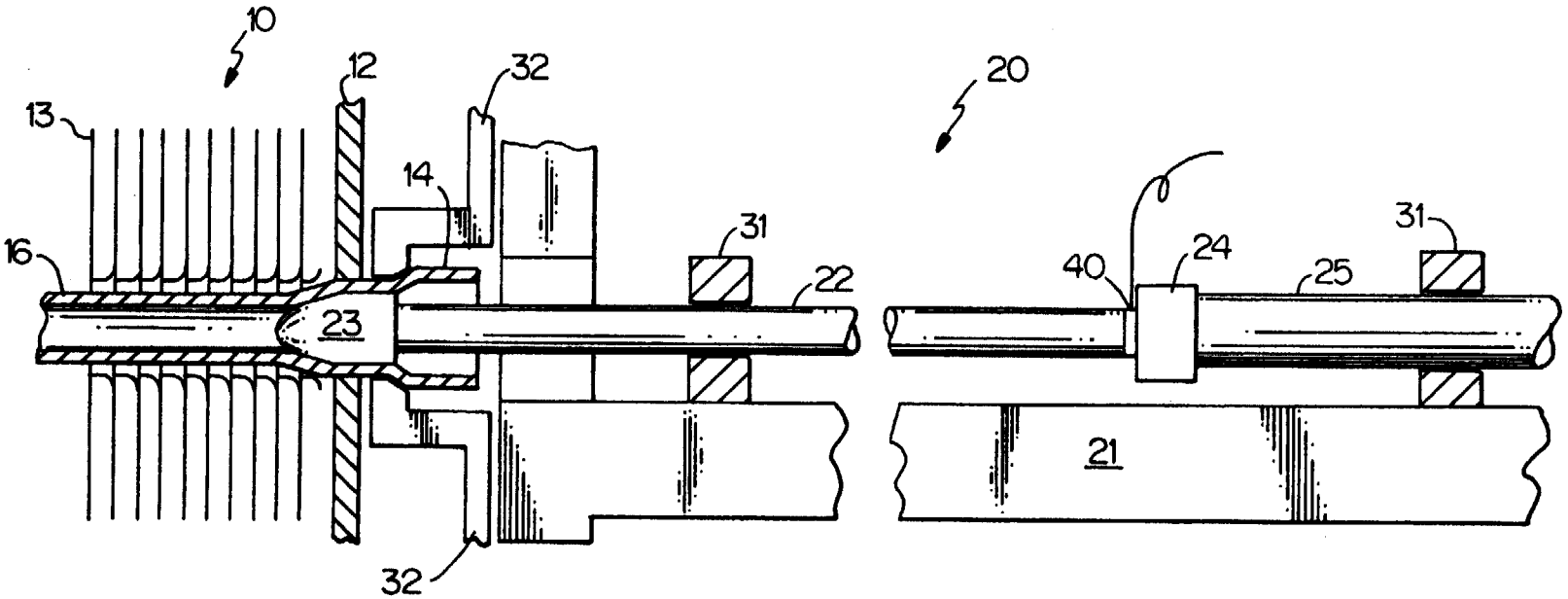
FIG. 2 is a side elevation view, partially sectioned, of an expander of the type upon which the present invention would be used.
Figure 8:
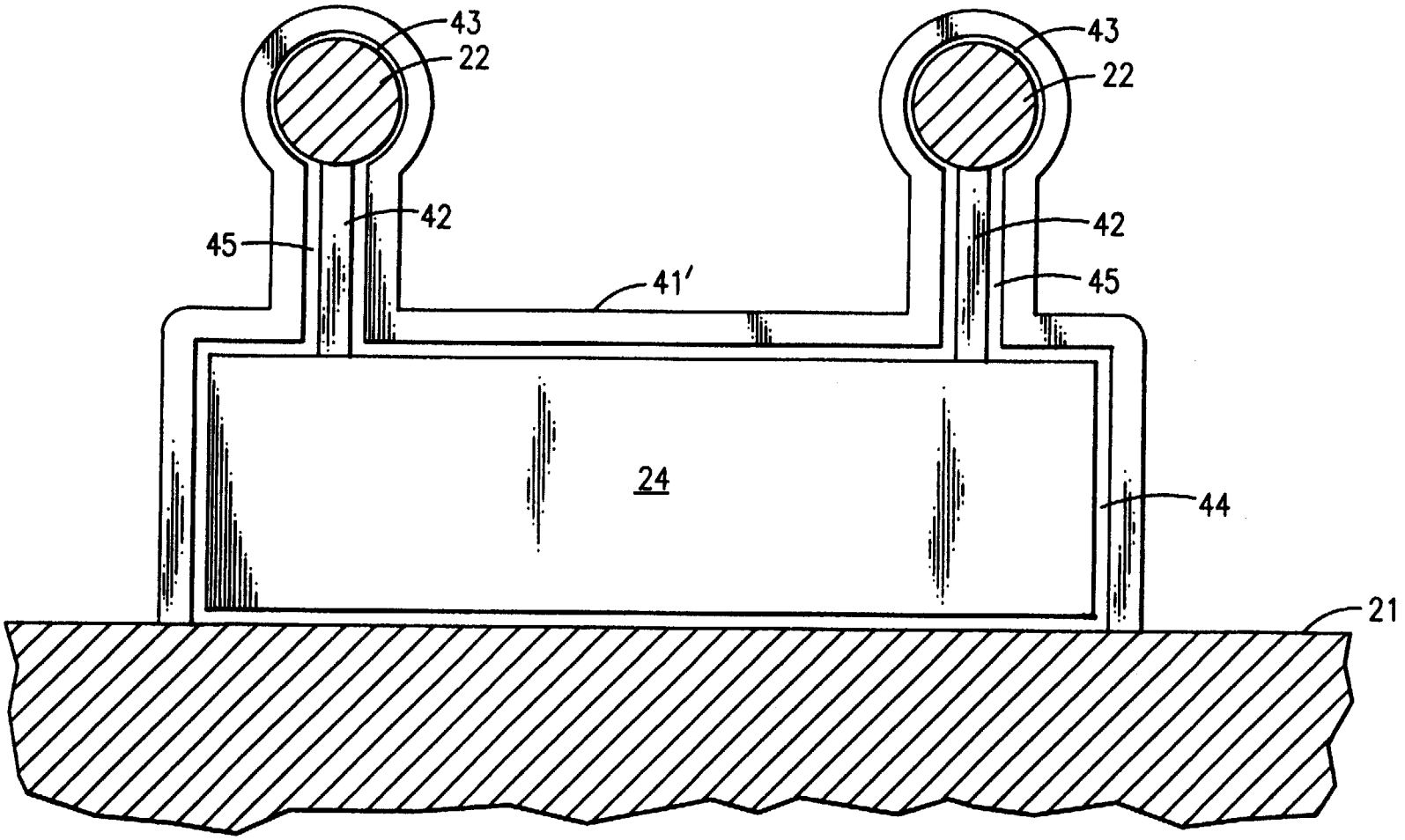
FIG. 8 is a partial sectioned elevation view of a tube expander having a rod support made according to another embodiment of the present invention.

Expanding a tube generally results in a change in the overall length of the tube. In expanding the tubes in a heat exchanger that has hairpin tubes, as is shown in FIG. 1, it is therefore desirable to expand both legs of a single hairpin tube at the same time so that both legs undergo the length change at the same time. If this is not done, the result can be distortion of the heat exchanger and also uneven projection of the ends of the hairpin legs, a condition that can cause difficulties in later steps in the manufacturing process. So that both legs of a single hairpin tube can be expanded, it may be desirable to drive at least a pair of expansion rods with a single yoke and ram shaft. Other factors, such as material cost and available space, may make driving multiple expansion rods with a single yoke and ram shaft necessary or desirable. The rod support apparatus of the present invention is capable of use in such an application. FIG. 8 depicts an embodiment of the invention in which a single yoke 24 drives two expander rods 22 through two connector links 42. In this embodiment, rod support member 41' has a single ram shaft channel 44 but two rod channels 43 and two link channels 45.

Other, more complex configurations are, of course, possible and within the scope of the present invention.

I claim:

1. An improved apparatus (20) for radially expanding a tube, said apparatus being of the type in which a ram (25), having a first axis of movement, through an expander rod (22) having a second axis of movement, drives an expander bullet (23) through said tube, in which the improvement comprises:

said first axis of movement being offset from said second axis of movement;

said ram imparting its driving force to said expander rod through a connector link (32);

a rod support member (31) having a first passage (43) surrounding said first axis of movement, a second passage (44) that provides a path for movement of said ram during a stroke of said expander rod, a third passage (45) connecting said first passage and said second passage and through which said connector link may pass.

* * * * *